US006053785A

United States Patent [19]

Kato et al.

[11] Patent Number: 6,053,785

[45] Date of Patent: Apr. 25, 2000

[54] EXHAUST SYSTEM AND CONTROL FOR MARINE PROPULSION ENGINE

[75] Inventors: Masahiko Kato; Yukinori Kashima, both of Hamamatsu, Japan

[73] Assignee: Sanshin Kogyo Kabushiki Kaisha, Japan

[21] Appl. No.: 09/086,275

[22] Filed: May 28, 1998

[30] Foreign Application Priority Data

May 28, 1997 [JP] Japan ..... 9-138492
May 28, 1997 [JP] Japan ..... 9-138493

[51] Int. Cl.[7] ..... B63H 21/32

[52] U.S. Cl. ..... 440/89; 123/195 P

[58] Field of Search ..... 440/88, 89, 900; 60/299, 310; 123/195 P

[56] References Cited

U.S. PATENT DOCUMENTS 4,965,997 10/1990 Suzuki et al. ..... 440/89
5,365,216 11/1994 Kotwicki et al. ..... 340/439
5,556,311 9/1996 Fujimoto .
5,562,510 10/1996 Suzuki et al. .
5,575,699 11/1996 Isogawa et al. .

*Primary Examiner*—Ed Swinehart
*Attorney, Agent, or Firm*—Knobbe, Martens, Olson & Bear, LLP

[57] ABSTRACT

An outboard motor exhaust system and control for insuring good running and effective exhaust gas silencing and treatment. The system includes a very compact exhaust system that includes an expansion chamber formed beneath the exhaust guide plate and to which the exhaust gases are delivered and removed at optimal locations. Furthermore, a feedback control employing a combustion condition sensor is employed along with a catalyst in the exhaust. Sensors are provided upstream and downstream of the catalyst to ensure that it is operating at optimum conditions.

17 Claims, 9 Drawing Sheets

EXHAUST SYSTEM AND CONTROL FOR MARINE PROPULSION ENGINE

BACKGROUND OF THE INVENTION

This invention relates to marine propulsion engines such as outboard motors and the exhaust and control systems therefor.

Outboard motors present a number of challenges to the designer. The prime reason for this is the very compact nature of an outboard motor. An outboard motor generally includes a powerhead that consists of a powering internal combustion engine and a surrounding protective cowling. A drive shaft housing and lower unit depends from the powerhead. This drive shaft housing and lower unit journals a drive shaft that is driven by the engine and a transmission which drives a propulsion device in the lower unit for propelling an associated watercraft.

One of the prime design considerations and problems in connection with outboard motors is the provision of an adequate exhaust system that permits relatively free breathing, good silencing and also which ensures that excess heat is not generated which can be transmitted to the other components of the outboard motor.

The silencing presents a significant problem in that the length of the exhaust system is substantially limited by the compact nature of the structure. Generally, it has been proposed to utilize one or more expansion chambers generally formed in the drive shaft housing and lower unit for assisting in the silencing of the exhaust gases.

It is also a practice in outboard motor construction to discharge the exhaust gases to the atmosphere through the body of water in which the watercraft is operating, at least under higher speeds of travel. By utilizing this under water exhaust gas discharge, the silencing of the exhaust gases can be augmented.

However, the use of the under water discharge provides certain problems in that there is a concern that water may be ingested into the engine through the exhaust system. This is a particular problem in connection with two cycle engines because of the firing impulses and the existence of negative pressures in the exhaust under some circumstances.

It has been proposed, therefore, to employ a trap arrangement that will assist in insuring against ingestion of water into the engine through the exhaust system.

Also, in the interest of obtaining a good exhaust emission control, catalysts have been proposed for use in the exhaust system. The catalyst, however, should be protected from the water so as to avoid damage. This presents other problems in connection with location of the components. It has been proposed also to position the catalyst at an upstream location from the trap device so as to insure its protection from water.

U.S. Pat. Nos. 5,556,311, 5,562,510, 5,575,699, and 5,595,516 show arrangements that have been proposed for utilizing expansion chambers formed in the drive shaft housing and traps in the powerhead with catalysts contained within the expansion chamber. These devices are quite effective in achieving the various results aforenoted.

However, because of the compact nature of the structure, the aforenoted arrangements have been configured in such a way that the communication to and from the expansion chamber has not been at the optimal location.

It is, therefore, a principal object of this invention to provide an improved outboard motor exhaust system that includes an expansion chamber and trap device.

It is a further object of this invention to provide an outboard motor exhaust system of this type wherein the exhaust gases are delivered to and from the expansion chamber at locations that are substantially on its center line, and yet spaced adequately from each other to obtain full benefit of the expansion chamber.

In addition it is a further object of this invention to provide an outboard motor exhaust system wherein the trap device is located in such a way as to insure that it will be effective and will also communicate in the desired relationship to the expansion chamber.

As has been noted, it is desirable in many instances to employ a catalytic treatment for the exhaust gases. However, it is also desirable to insure that the operation of the catalyst is monitored so that if the catalyst becomes depleted or is not operating at maximum efficiency, corrective actions can be taken.

It is, therefore, a still further object of this invention to provide an engine control that employs a system for monitoring the condition of the catalyst.

It is a still further object of this invention to provide an improved catalyst sensing system for an engine control.

SUMMARY OF THE INVENTION

A first feature of the invention is adapted to be embodied in an outboard motor that is comprised of a powerhead that consists of an internal combustion engine and a surrounding protective cowling. A drive shaft housing and lower unit depends from the powerhead and contains a propulsion device for an associated watercraft. An exhaust guide plate underlies the engine at the upper end of the drive shaft housing and lower unit. Transmission means drive the propulsion device from the engine. The engine has at least one exhaust port for discharging combustion products. An exhaust system is provided for discharging the exhaust gases from the exhaust port to the atmosphere through the body of water in which the associated watercraft is operating under at least some running conditions. The exhaust system includes an expansion chamber forming member that is affixed to the underside of the exhaust guide plate and which defines therewith an expansion chamber. An exhaust manifold extends from the exhaust port into the expansion chamber at a point lying substantially on a longitudinal center line of the outboard motor and at a forward location in the expansion chamber. A trap portion is formed in substantial part on the upper side of the exhaust guide plate. The trap portion consists of an inlet section that extends upwardly from an inlet opening in the expansion chamber that is disposed substantially on the longitudinal center line and at a rearward location from the exhaust manifold. A horizontally extending portion of the trap extends generally transversely to the longitudinal center line. A downwardly extending section of the trap lies on one side of the expansion chamber forming member.

Another feature of the invention is adapted to be embodied in a catalytic control system for controlling and purifying the exhaust gases of an internal combustion engine. The engine has an exhaust port and which communicates with an exhaust system for discharging the exhaust gases to the atmosphere. A catalyst is positioned in the exhaust system. A first combustion condition sensor senses the condition of the combustion products in a combustion chamber of the engine which communicates with the exhaust port. A second combustion condition sensor senses the condition of the exhaust gases at a point contiguous to the downstream end of the catalyst. Means are provided for determining the condition of the catalyst based upon the relative outputs of the combustion condition sensors.

DETAILED DESCRIPTION OF THE PREFERRED EMBODIMENTS

Figure 1:
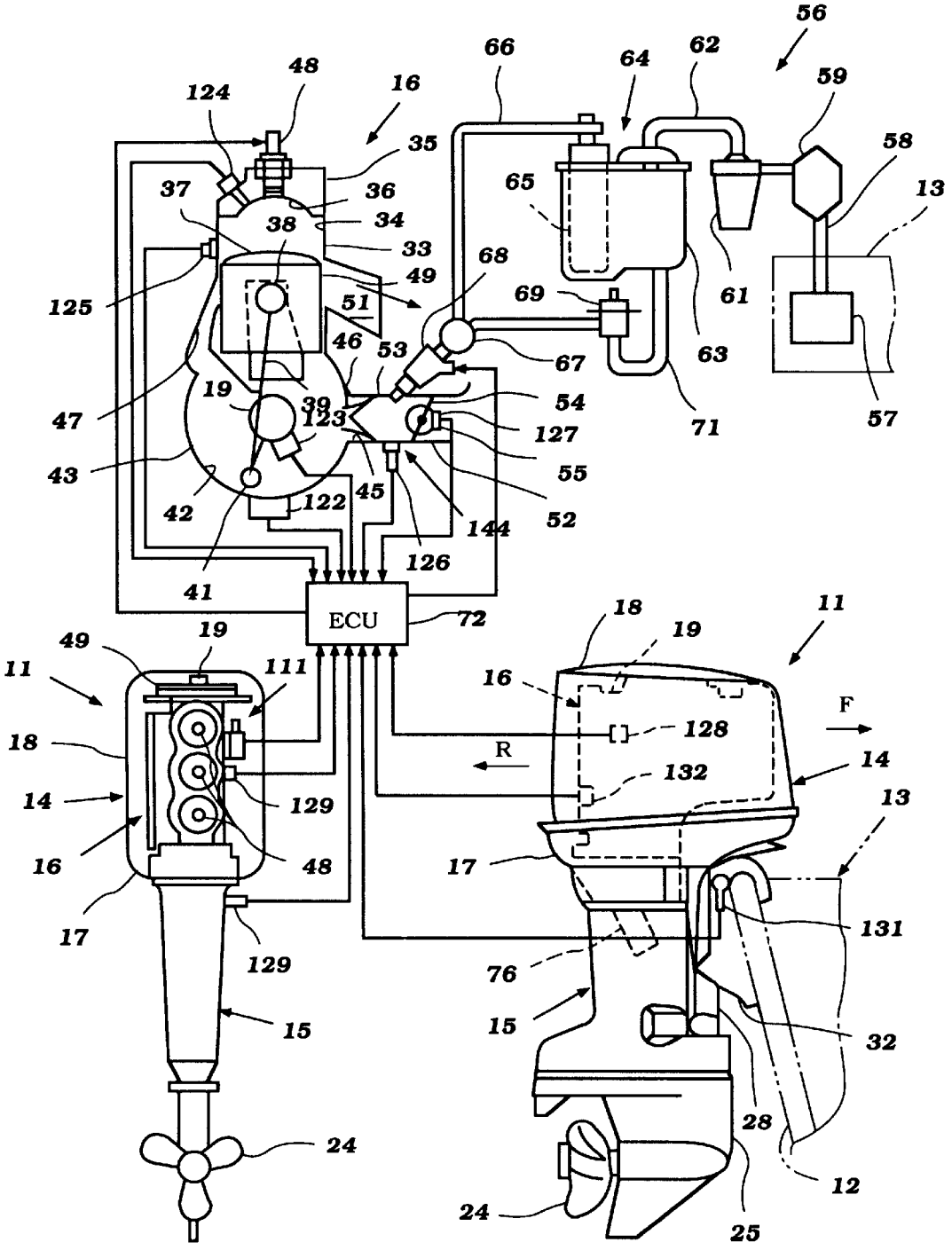
FIG. 1 is a three part view with the lower two portions showing an outboard motor and the upper portion of the view showing the engine of the outboard motor in cross-section and its fuel supply system in somewhat schematic fashion. The three view portions are linked together by the ECU that performs the engine control.
Figure 2:
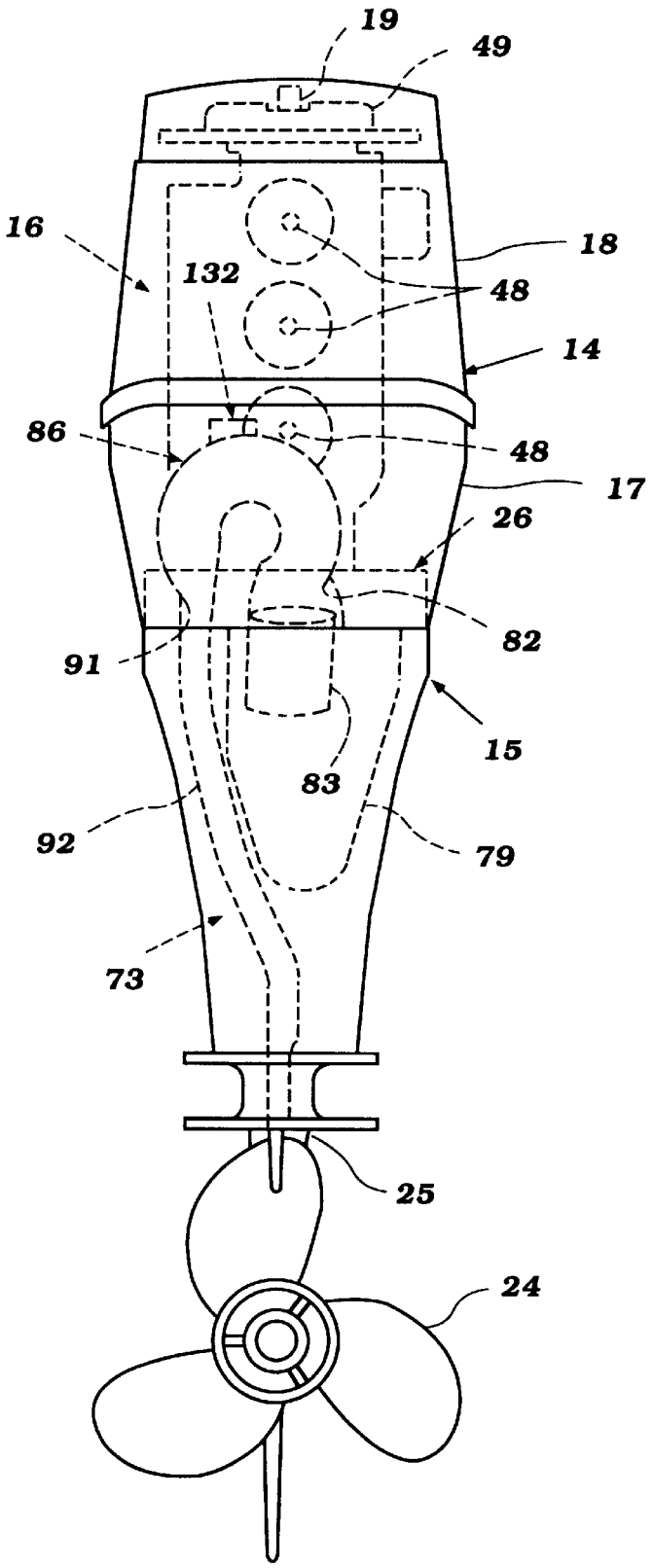
FIG. 2 is an enlarged rear elevational view of the outboard motor looking generally in the same direction as the lower left hand portion of FIG. 1.

Referring now in detail to the drawings and first primarily to FIG. 1, an outboard motor constructed in accordance with an embodiment of the invention is identified generally by the reference numeral 11 and is shown in primary part in the lower two view portions of this figure. The outboard motor 11 is depicted as being attached to the transom 12 of an associated watercraft, indicated generally by the reference numeral 13 and shown in phantom. The manner of this attachment will be described later.

As is typical with outboard motor practice, the outboard motor 11 is comprised of a powerhead portion 14 from which a drive shaft housing and lower unit portion 15 depends. The powerhead portion 14 consists of an internal combustion engine 16, which is shown in schematic cross-section in the upper view of this figure. This engine 16 is surrounded by a protective cowling which is comprised of a lower tray portion 17 and a main cowling portion 18 that is detachably connected in a known manner to the tray portion 17. Further details of the powerhead will be described shortly by reference additionally to FIGS. 2 through 4 and 8.

As is typical with outboard motor practice, the engine 16 is mounted in the powerhead 14 so that its output shaft, a crankshaft indicated by the reference numeral 19, rotates about a vertically extending axis. This is done so as to facilitate connection of the crankshaft 19 to a drive shaft, shown in FIG. 5 and which is indicated by the reference numeral 21. This drive shaft 21 is journaled in a suitable manner in the drive shaft housing and lower unit 15.

The drive shaft depends into the lower unit portion of this assembly where it drives a propeller 22 via a conventional bevel gear reversing transmission 23. A propulsion device such as a propeller 24 is affixed to the propeller shaft 22 in a suitable manner for propelling the watercraft 13 through the body of water in which it operates.

Figure 5:
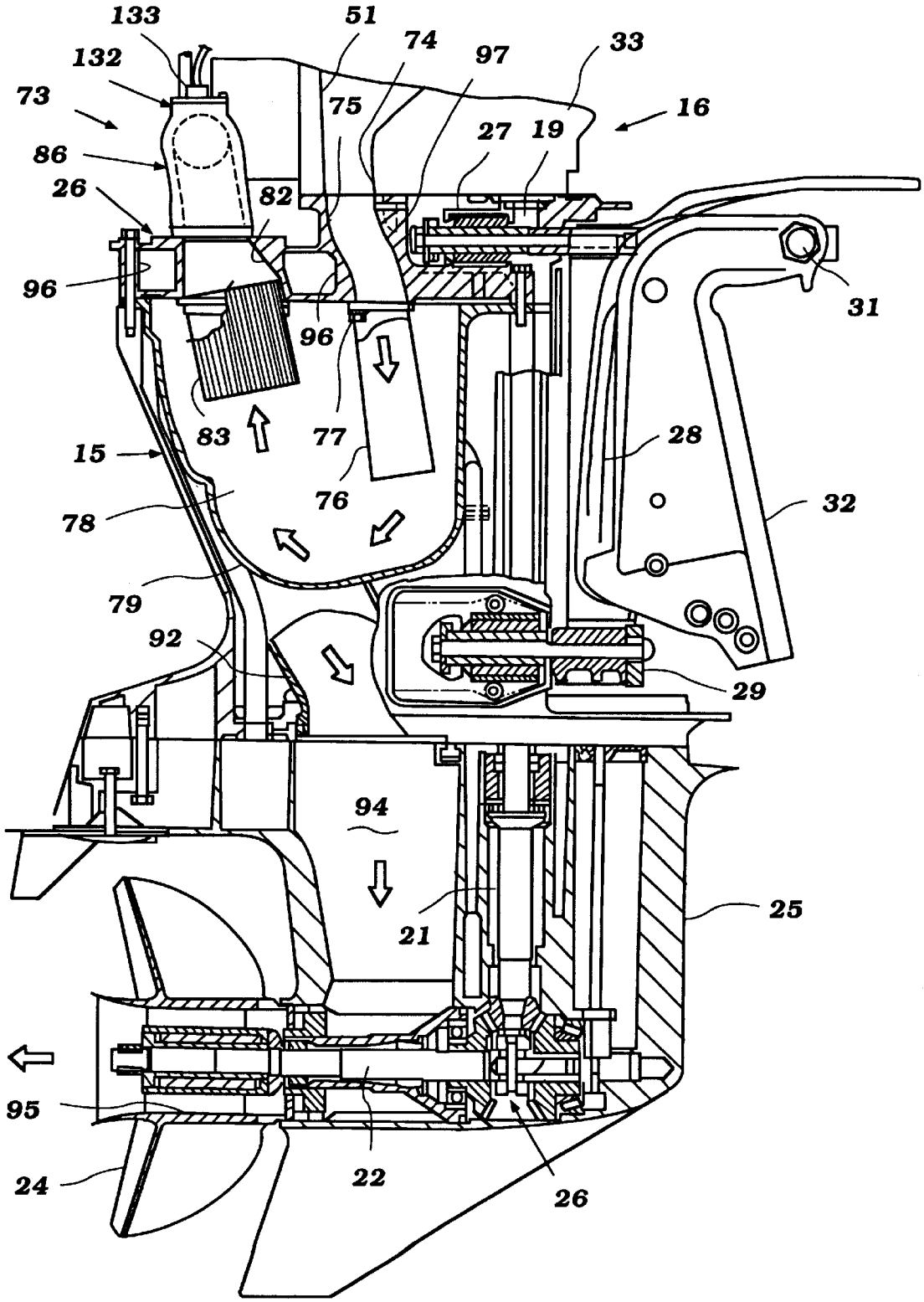
FIG. 5 is a partial view looking generally in the same direction as the lower right hand portion of FIG. 1 but with portions broken away and shown in section.

Referring now primarily to FIG. 5, it should be noted that the drive shaft housing lower unit 15 is comprised of an outer housing assembly 25 which is generally open at its upper end. This open upper end is substantially closed by an exhaust guide plate 26 which is affixed thereto by a fastener assembly and upon which the engine 16 is supported.

A pair of upper elastic isolator assemblies 27 connect this exhaust guide plate 26 to the upper end of a steering shaft which does not appear in the figures but which is journaled for steering motion within a swivel bracket assembly 28. The lower end of this steering shaft is affixed to the drive shaft housing lower unit 15 by means of a pair of lower elastic assemblies 29 so as to dampen vibrations of the outboard motor 11 from the transom 12 and hull 13. The support of the steering shaft in the swivel bracket 28 permits steering motion of the outboard motor 11 in a manner well known in this art.

The swivel bracket 28 is, in turn, pivotally connected by a pivot pin 31 to a clamping bracket 32. This pivotal connection permits tilt and trim movement of the outboard motor 11 as is also well known in this art. The clamping bracket 32 is detachably connected in a known manner to the hull transom 12.

The construction of the engine 14 will now be described by primary references to FIGS. 1, 3 and 4. The engine 16 is, in the illustrated embodiment, of the three cylinder inline type and operates on a two stroke principle. Although the invention is described in conjunction with such an engine, it will be readily apparent to those skilled in the art how the invention can be practiced with a wide variety of types of internal combustion engines having varying cylinder numbers and operating on various principles.

The engine 14 includes a cylinder block 33 which is formed with three cylinder bores, one of which is shown schematically in FIG. 1 and identified by the reference numeral 34. These cylinder bores 34 are arranged so that their axes extend horizontally to accommodate the vertical rotational axis of the crankshaft 19 aforenoted. The cylinder bore axes are spaced vertically from each other and lie in a common vertically extending plane which may be considered to be a longitudinal center plane of the powerhead. This plane will be identified further as this description proceeds.

One end of the cylinder bores 34 is closed by a cylinder head assembly 35 which is affixed to the cylinder block 33 in any known manner. This cylinder head assembly 35 is provided with individual recesses 36 formed at one end of the cylinder bores 34 and which form with the cylinder bores 34 and pistons 37 the individual combustion chambers of the engine. At times, the reference numeral 36 will be utilized to also identify these combustion chambers. This is because, at top dead center of the pistons 37, the cylinder head recesses 36 form a substantial portion of the clearance volume of the engine.

The pistons 37 reciprocate in the cylinder bores 34. Each piston 37 is connected by a respective piston pin 38 to the small end of a connecting rod 39. The big ends of the connecting rods 39 are journaled on throws 41 of the crankshaft 19 in a known manner.

The crankshaft 19 rotates in a crankcase chamber 42 which is formed by the skirt of the cylinder block 33 and a crankcase member 43 that is detachably connected thereto. The manner of journaling the crankshaft 19 for this rotation may be of any type known in the art.

As is typical with two-cycle crankcase compression engines, the portions of the crankcase chamber 42 associated with each cylinder bore 34 are sealed relative to each other. An air induction system, indicated generally by the reference numeral 44 is provided for communicating an air supply system, to be described, with the individual crankcase chambers 42 associated with cylinder bore 34.

This induction system includes intake ports 45 formed in the crankcase member 42. Reed-type check valves 46 are provided in each of these intake ports 45 so as to permit the charge to be drawn into the crankcase chambers 42. This induction occurs when the pistons 37 are moving upwardly in the cylinder bores 34 and the volume of the crankcase chambers 42 is increasing. When the pistons 37 moved downwardly in the cylinder bores 34, the reed-type valves 46 will close and preclude reverse flow.

The charge in the crankcase chambers 42 is then compressed and is transferred to the combustion chambers 36 through one or more scavenge passages 47. This charge is then further compressed in the combustion chambers and is fired by spark plugs 48 mounted in the cylinder head assembly 35. The spark plugs 48 are fired by an ignition system which will be described in more detail later and which includes, among other things, a flywheel magneto assembly 49 that is affixed for rotation with the upper end of the crankshaft 19.

As the gases burn and expand to drive the pistons 37 downwardly in the cylinder bores 33, eventually exhaust ports 49 formed in the cylinder block 33 will be opened. The exhaust gases then flow through an exhaust system which includes an exhaust manifold 51 which consist of a collector section formed in the cylinder block 33 and which is discharged downwardly to the atmosphere through the driveshaft housing and lower unit 15 in a manner which will be described later by reference to FIGS. 5–7.

The induction and associated charge forming system for the engine 16 will now be described by primary reference to FIGS. 1, 3 and 4. This induction system 44 is shown for the most part schematically and includes an air inlet device and silencer which is not shown. This air inlet device and silencer is positioned within the protective cowling member 18 and receives atmospheric air that is admitted to the interior of the cowling member 18 through a suitable inlet system.

This air is then delivered to intake pipes 52 each of which terminates at a throttle body 53. A throttle valve 54 is positioned in each throttle body 53. The throttle valves 54 are mounted on a common throttle valve shaft 55 that is controlled by a throttle control arrangement shown partially in FIG. 3 and identified by the reference numeral 56. A remote wire actuator mechanism is operated by the operator for controlling the position of the throttle valves 54 and, accordingly, the speed of the engine 16.

The induction system 44 also incorporates a charge forming system which includes a fuel supply arrangement, indicated generally by the reference numeral 56. This fuel supply system includes a fuel tank 57 that is positioned at an appropriate location within the watercraft hull 13. A fuel supply conduit 58 extend from this tank 57 to a quick disconnect arrangement (not shown) which, in turn, communicates with low pressure pumps 59 driven suitably from the engine 16.

Figure 4:
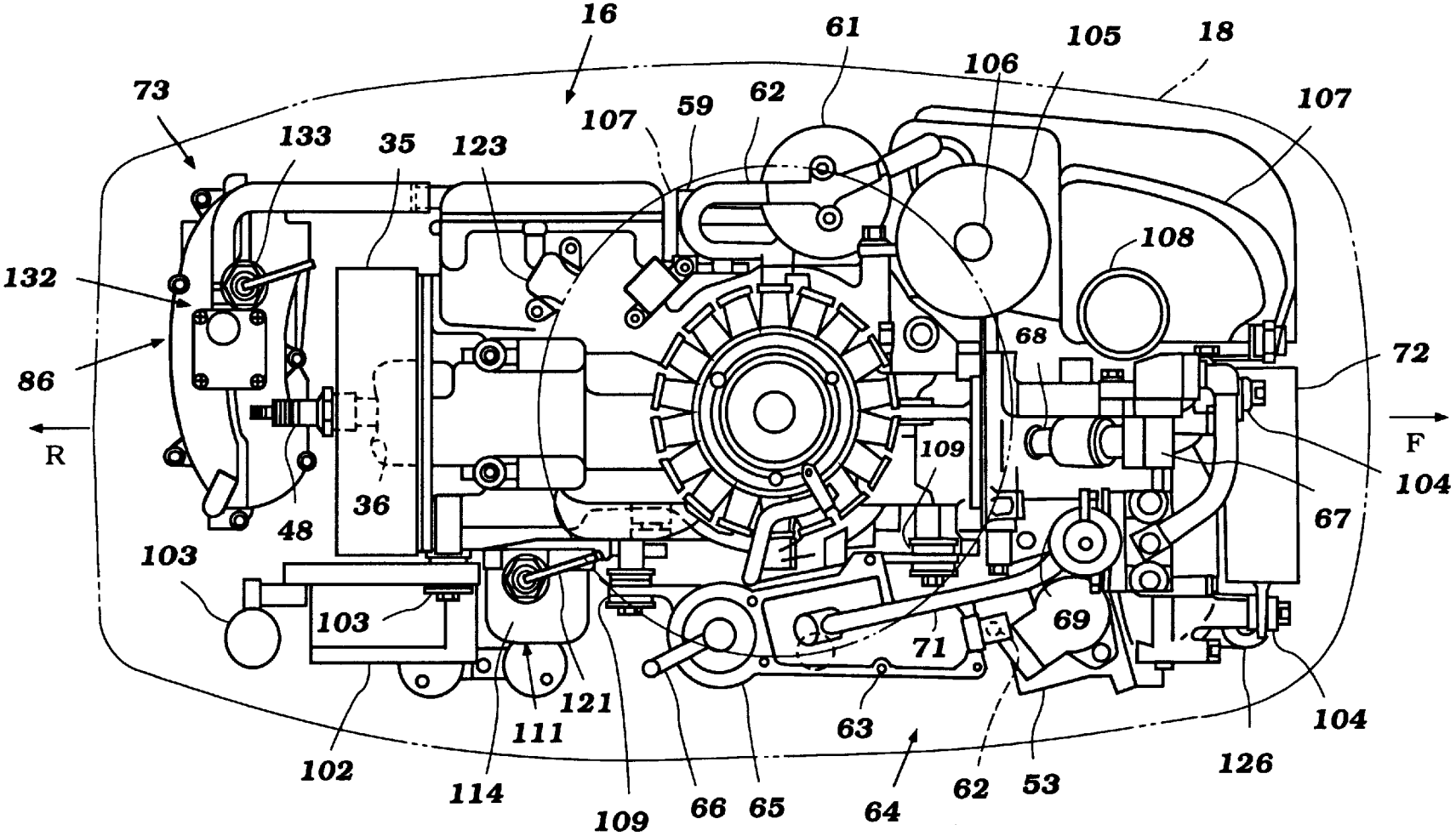
FIG. 4 is a top plan view of the powerhead with the protective cowling shown in phantom.

The low pressure pumps 59, in turn, deliver the fuel to a filter and water separator unit 61 which is mounted at an appropriate location within the powerhead and preferably as seen in FIG. 4, at one side of the crankcase member 43.

A conduit 62 then transfers this fuel that has been filtered and had the water separated to a vapor separator unit 63 that is disposed on the opposite side of the crankcase member 43. This forms a portion of a high pressure fuel supply system, indicated generally by the reference numeral 64. This high pressure fuel supply system 64 includes a high pressure pump 65 which is positioned within the vapor separator 63 and thus, is cooled by the surrounding fuel.

From the high pressure fuel pump 65, fuel is delivered through a supply conduit 66 to a fuel rail 67. The fuel rail 67, in turn, communicates with fuel injectors 68 which are mounted in the throttle body 53 for spraying fuel into the throttle body induction passage in a direction toward the reed-type check valves 46.

The pressure of fuel supplied to the fuel injector 66 via the fuel rail 67 is controlled by a pressure regulator 69. The pressure regulator 69 regulates the fuel pressure by dumping excess fuel back to the vapor separator 63 through a return line 71.

The fuel injectors 68 are of the electronically type operated type and these are operated by an ECU, indicated generally by the reference numeral 72, in accordance with a strategy which will be described later.

The exhaust system by which the exhaust gases from the combustion in the combustion chambers 36 is discharged to the atmosphere will now be described by principal reference to FIGS. 2, 3 and 5–7. This exhaust system is indicated generally by the reference numeral 73. The exhaust system 73 includes the aforenoted exhaust manifold 51 which is formed in the cylinder block 33. This exhaust manifold 51 terminates in a discharge opening 74 in a lower face of the cylinder block 33 and which communicates with an exhaust gas inlet passage 75 that is formed in the exhaust guide plate 26.

A short exhaust pipe 76 is affixed to the underside of the exhaust guide plate 26 in registry with the exhaust passage 75 by threaded fasteners 77. This exhaust pipe 76 is contained within a first expansion chamber 78 that is formed by an expansion chamber forming member 79 and the exhaust guide plate 26. The expansion chamber member 79 is affixed to the underside of the exhaust guide plate 26 by a plurality of threaded fasteners.

Figure 6:
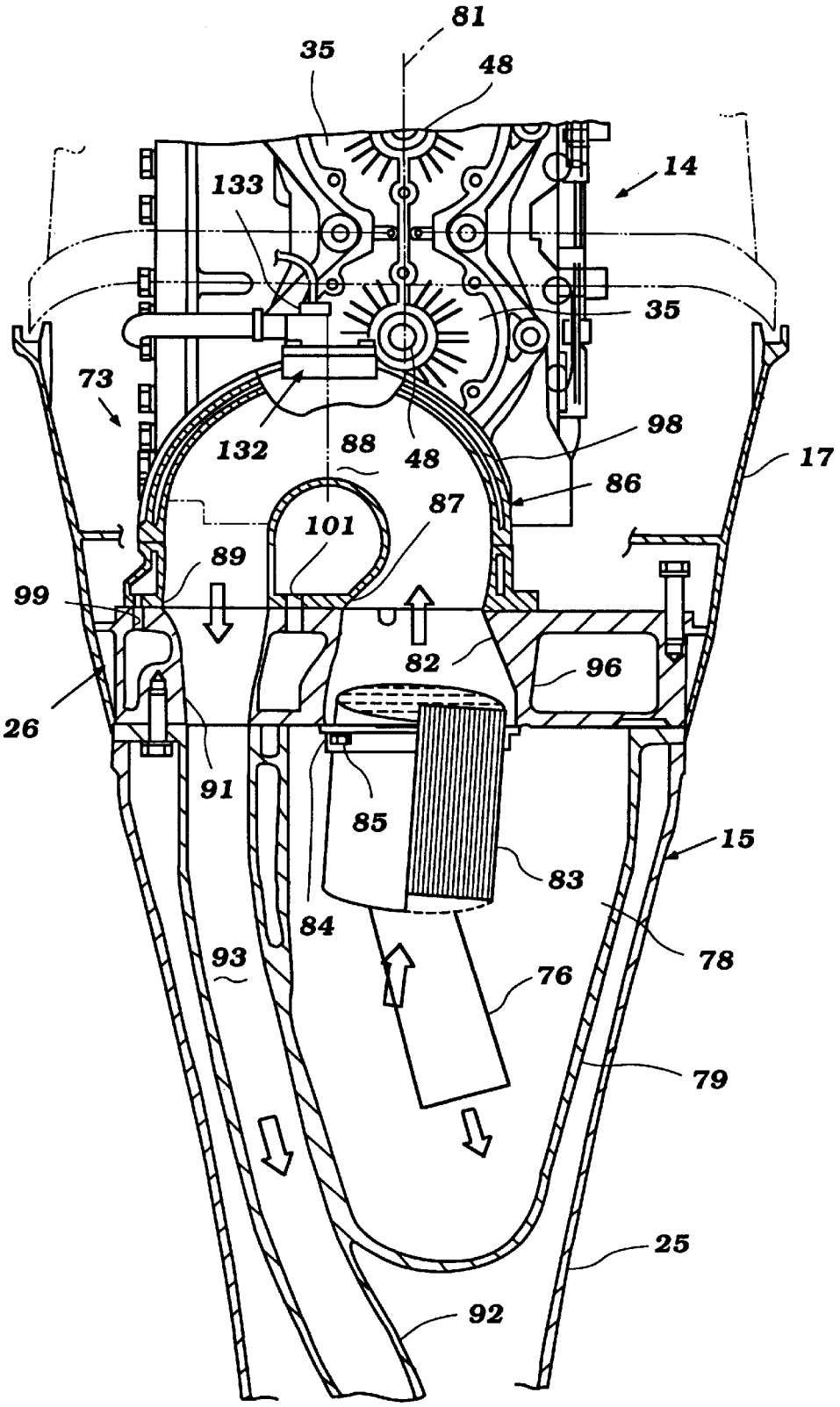
FIG. 6 is a partial cross-sectional view of the same portion of the outboard motor as shown in FIG. 5, but is taken through the trap section.
Figure 7:
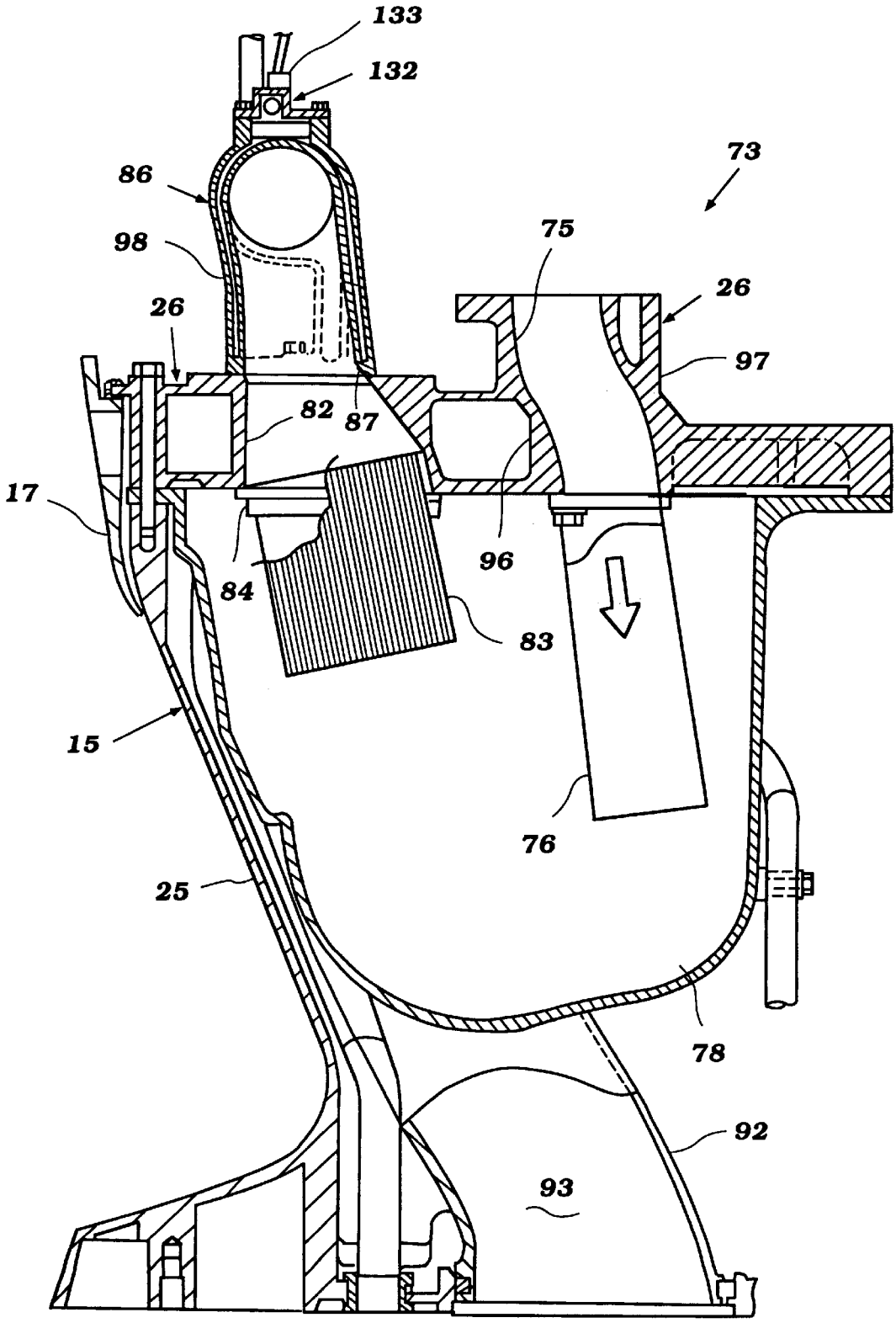
FIG. 7 is an enlarged view looking in the same direction as FIG. 5, but with the engine removed.
Figure 8:
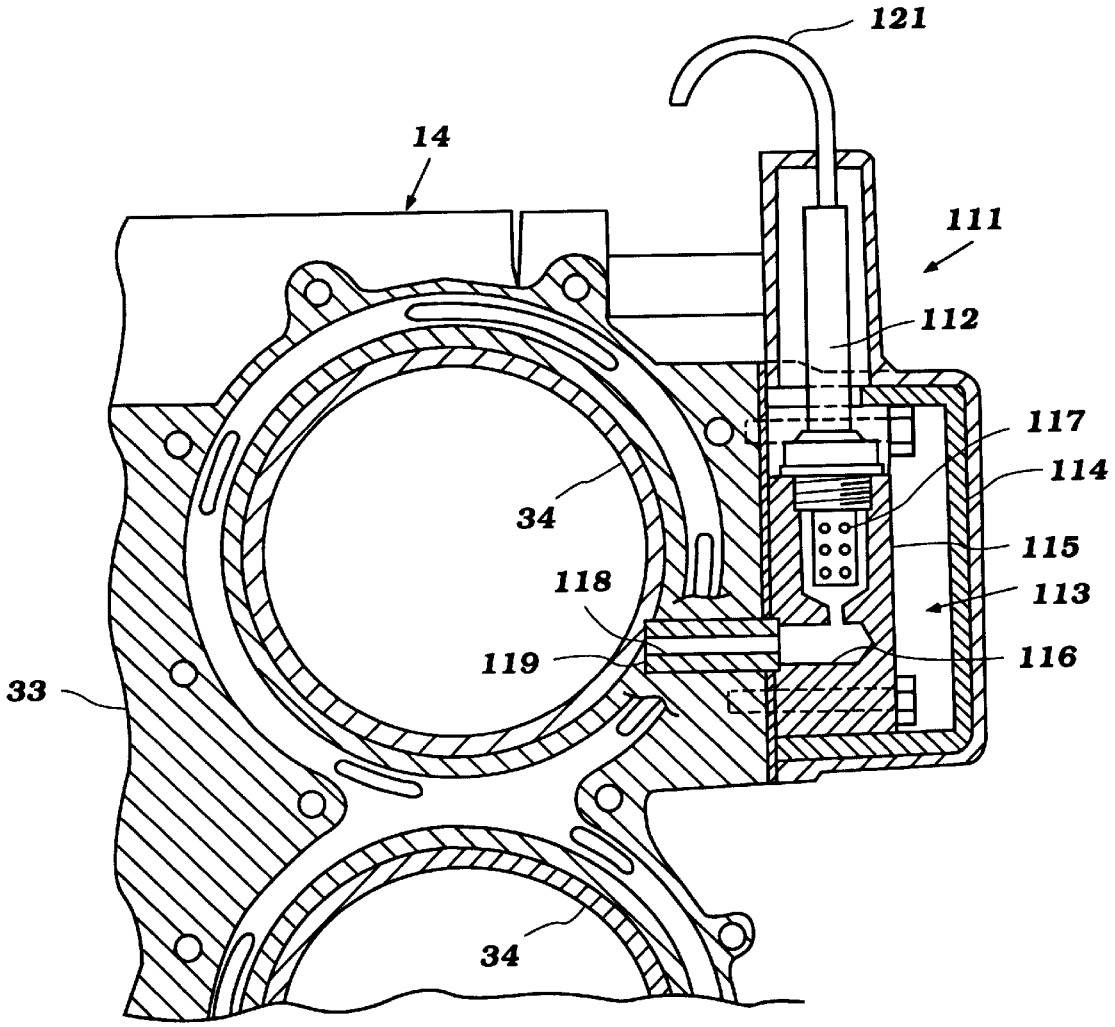
FIG. 8 is a cross-sectional view taken through the cylinder block and shows the combustion condition sensor associated directly with one of the combustion chambers.

It should noted that the exhaust pipe 76 is located generally on the aforenoted longitudinal center plain of the engine, which appears in FIG. 6 and is identified by the reference numeral 81. The exhaust pipe 76 terminates generally at the vertical center of the expansion chamber 78 and also generally at its center in a transverse direction so as to obtain maximum benefit of the value of the expansion chamber 78 in silencing the exhaust sounds. That is, the exhaust gases emanating from the exhaust pipe 76 will be able to expand fully into the expansion chamber volume 78.

Spaced rearwardly from the exhaust guide exhaust inlet passage 75 an exhaust guide outlet passage 82 is formed. A catalyst 83 is supported across the mouth of the exhaust guide outlet passage by a support ring 84. The support ring 84 is affixed to the underside of the exhaust guide plate 26 by threaded fasteners.

The catalyst bed 83 is of a suitable type and all exhaust gases must pass through it before they can enter the exhaust guide outlet passage 82. Thus, complete catalytic treatment of the exhaust gases is possible. Also, the catalyst bed 83 may be conveniently serviced by removing the exhaust guide plate 26 from the lower unit 15 and detaching the fasteners 85 for servicing or replacement.

Since the exhaust gases are discharged to the atmosphere through the body of water in which the watercraft 13 is operating under most running conditions, it is desirable to provide some form of water protection so that water will not impinge upon the catalyst bed 83 nor can water enter the engine through the exhaust ports 49.

To achieve this end, a trap section, indicated generally by the reference numeral 86, is provided on the upper side of the exhaust guide plate 26 and within the powerhead 14. This exhaust trap 86 is comprised of an inlet section 87 that communicates directly with the exhaust outlet passage 82 and extends vertically upwardly.

The trap inlet section terminates at a generally horizontally extending section 88 which extends transversely across the powerhead portion 14 to one side thereof. This horizontally extending section 88 terminates in a further vertically extending section 89 that extends downwardly and which communicates with a further exhaust passage 91 formed in the exhaust guide plate 26 to one side of the exhaust outlet opening 82 and in general longitudinal alignment with it.

The expansion chamber forming member 79 also has an exhaust pipe section 92 that defines an exhaust passage 93 which communicates at its upper end with the exhaust guide plate passageway 91. This exhaust pipe section 92 terminates at a further expansion chamber 94 that is formed in the lower unit portion of the housing 95.

This expansion chamber section 94 communicates with a through-the-hub high speed exhaust gas discharge passage 95 formed in the hub of the propeller 24. Thus, when operating at high speeds and high watercraft speeds, the exhaust gases will be discharged beneath the level of water which the watercraft is operating so as to provide very effective silencing and cooling of the exhaust gases.

If desired, the outboard motor 11 may be provided with an above-the-water exhaust gas discharge of any known type so as to facilitate the discharge of exhaust gases at times when the through-the-hub exhaust 95 is relatively deeply submerged. This type of exhaust system is well known in any of the known types of above-the-water exhaust gas discharges may be utilized in conjunction with the invention.

The engine 14 is water cooled and to this end its cylinder block 33 and cylinder head assembly 35 are provided with cooling jackets through which water is circulated in a well known manner. This water is drawn from the body of water in which the watercraft is operated and is circulated by a coolant pump that is driven off of the driveshaft 21 in a manner known in this art.

Since a portion of the exhaust system 73 is located within the powerhead 14 and to assist in exhaust gas silencing, both the exhaust guide plate 26 and the trap section 86 are provided with cooling jackets through which this cooling water is also circulated.

The exhaust guide cooling jacket is indicated generally by the reference numeral 96 and, as may be seen best in FIGS. 3 and 5–7, this cooling jacket 96 encircles an exhaust inlet section 97 of the exhaust guide plate 26 and the inlet and outlet sections 82 and 91 that communicate with the trap section 86. In addition, the trap section 86 is provided with a cooling jacket 98 that communicates with the exhaust guide plate cooling jacket 96 through passages 99 and 101. This cooling water is then returned to body of water in which the watercraft is operating through any suitable drain arrangement.

It has been noted that the spark plugs 48 are fired by a suitable ignition system which is powered by the flywheel magneto 49. This ignition system is of the capacitor discharge type and includes a control box 102 (FIGS. 3 and 4) that is mounted on the cylinder head assembly 35 by means that includes elastic isolator 103. This capacitor discharge unit 102 cooperates with coils 103 that are mounted adjacent to it and the spark plugs 48. Cables connect each coil to the respective spark plug 48 for firing the spark plugs 48 in a known manner.

As has been noted, the engine includes the ECU 72 that controls engine operation by controlling the timing of injection and duration of injection by the fuel injector 68 and also the timing of firing of the spark plugs 48 by controlling the CDI unit 102. For protection and cooling, the ECU 72 is mounted by elastic isolators 104 on an air box of the induction system.

Before describing the control strategy by which the ECU 72 operates to control the fuel injectors 68 and the firing of the spark plugs 48, certain other auxiliaries associated with the engine 14 will be described because their location and positioning is important in providing the compact assemblage required for an outboard motor.

The engine 14 may be provided with an electric starter motor 105 (FIGS. 4) that is mounted on a side of the engine opposite to the fuel vapor separator 63. This starter motor 105 has a pinion gear 106 that engages a ring gear 107 on the flywheel magneto assembly 49 for electric starting of the engine 14.

In addition, the engine 14 may be provided with a separate lubricating system for lubricating its components. This lubricating system includes an oil tank 107 (FIG. 4) that is mounted in proximity to the starter motor 105 and on the opposite side from the vapor separator 63. A fill cap 108 on the upper portion of the oil tank 107 permits replenishing of the oil therein.

Figure 3:
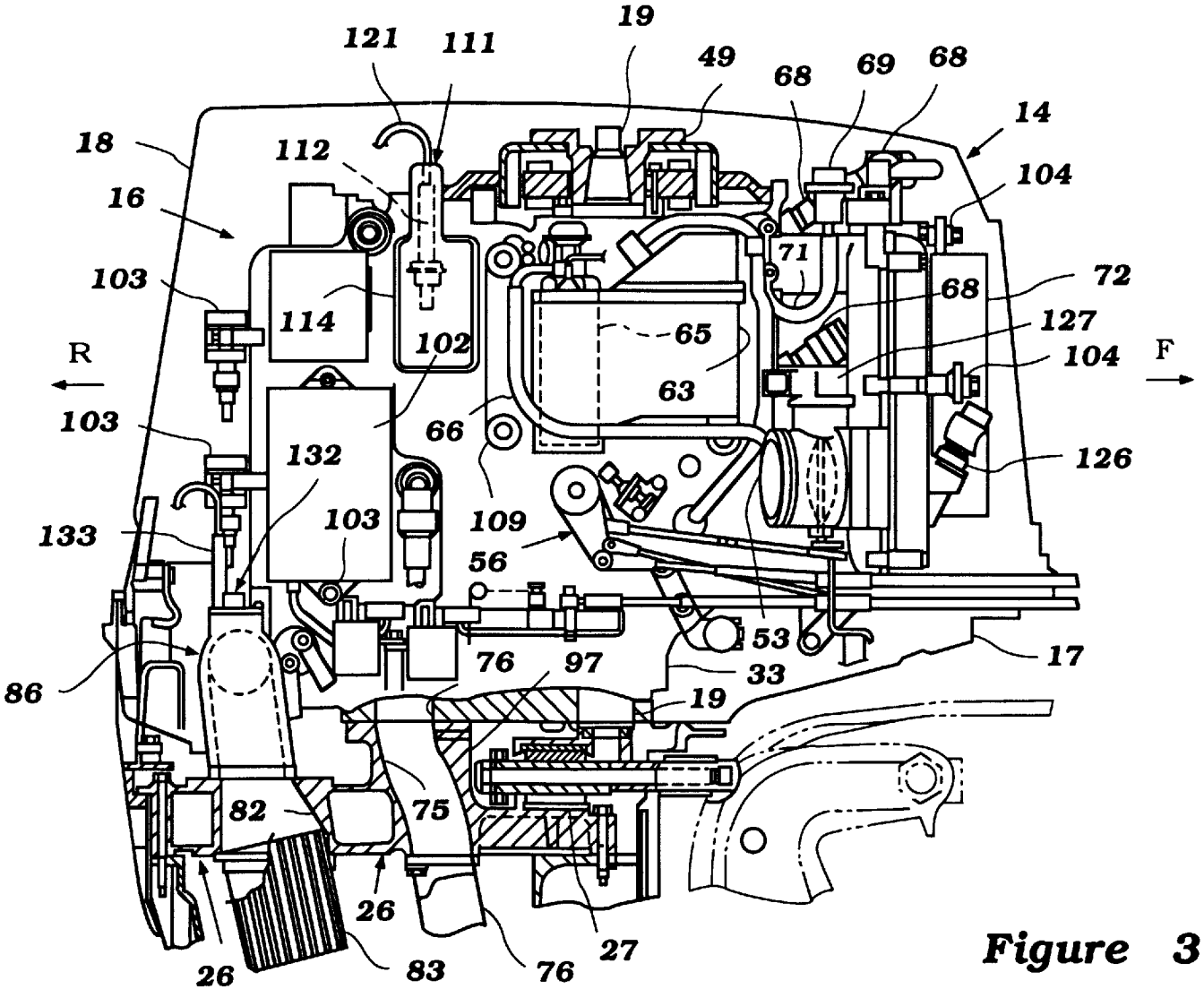
FIG. 3 is a side elevational view of the powerhead of the outboard motor with the protective cowling shown in outline and portions broken away and shown in section.

It should be noted that the vapor separator 63 is mounted on the cylinder block 33 by elastic isolators 109 which appear also in FIG. 4 as well as FIG. 3.

Referring now to the engine control provided by the ECU 72, the engine ECU 72 basically incorporates a form of feedback control for maintaining the desired air fuel ratio. To this end, there is provided a combustion condition sensor, indicated generally by the reference numeral 111 and which appears in certain of the figures but which is shown in full detail in FIG. 8. This combustion condition sensor 111 includes a sensor element 112 that is mounted within a sensor chamber 113 formed by insulated housing assembly 114 that is affixed to a side of the cylinder block 33 in proximity to one of the cylinder bores 34. In the illustrated embodiment, the uppermost or top cylinder bore 34 is the one with which the sensor assembly 111 is associated.

The housing assembly 114 encloses a sensor mounting element 115 which forms a sensor cavity 116 into which the tip 117 of the sensor 112 extends. This sensor cavity 116 communicates directly with the combustion chamber 36 through a passage forming member 118 formed by an insert that is fixed into the cylinder block 33.

This passage forming member 118 communicates with a port 119 which opens directly into the cylinder bore 34 at a point in proximity to the associated exhaust port 49. In this way, the port 119 will be opened at a time when the combustion has substantially completed. Preferably, the sensor element 117 is of the oxygen ($O_2$) type that tells the air fuel ratio by sensing the residual amount of oxygen in the combustion gases. The sensor element 112 has a lead 121 that provides this signal to the ECU 72.

In addition to the output from the oxygen sensor 111 certain other conditions may be sensed for engine control. In addition to engine conditions, these may include conditions of the outboard motor 11 per se and/or atmospheric and watercraft conditions. The sensed conditions will be described generally in a summary fashion by particular reference to FIG. 1, although many of the sensors also appear in other figures. It is to be understood, however, that this description of the sensed conditions is only typical of the various conditions that may be sensed in connection with the engine control.

These sensors include a crankcase pressure sensor 122 that senses the pressure in the crankcase chamber 42. It has been found that by measuring pressure or pressure differences, at specific crank angles, the intake air volume for the cylinder can be accurately determined. Also, associated with the crankshaft 19 is a crank angle sensor 123. By sensing the crankshaft angle it is possible to determine the specific position of the crankshaft and, in addition, by measuring pulses in time the speed of rotation of the crankshaft can be determined. The actual physical location of the crank angle sensor 123 may be seen in FIG. 4 and this is associated with the teeth of the flywheel ring gear 107 as an example.

In cylinder pressure as measured by a pressure sensor 124 that is mounted in the cylinder head assembly 35 and which is associated with one of the combustion chamber recesses 36.

Engine knock may be determined by a knock sensor 125 that is associated with the cylinder block 33 and senses knocking conditions in a known manner for example by sensing vibrations.

The temperature of the inducted air is measured by a intake air temperature sensor 126 which may be mounted in the throttle body or in a portion of the intake air device and thus, is shown in actual physical location in FIGS. 3 and 4.

Engine or operator load demand is determined by a throttle position sensor 127 that is mounted on the throttle body 53 and which senses the angular position of the throttle valve shaft 55 and, accordingly, the throttle valve 54. This is an indication of operator demand.

Engine coolant temperature or the temperature of the water which is delivered to the engine is determined by a water temperature sensor 128. In addition, actual cylinder temperature is sensed by a sensor 129 that communicates with the cylinder block cooling jacket in proximity to one of the cylinder bores 34.

Exhaust gas back pressure is also a condition which is sensed in connection with the control strategy and to this end there is provided a back pressure sensor 129. This sensor 129 may sense, for example, the pressure in the expansion chamber 78.

It has also been noted that other conditions may be desirable to sense in connection with engine control. This includes the trim angle of the outboard motor 11. Thus, associated with the trim condition of the swivel bracket 128 there is provided a trim angle sensor 131.

As has been noted, the aforenoted conditions are only typical of those conditions which may be sensed for engine control. Those skilled in the art will readily understand that various control strategies may be employed for achieving the engine feedback control. Since the invention deals primarily with the construction and configuration of the exhaust system 73 and arrangement for sensing the condition of the condition of the catalyst 83 now to be described.

As has been noted, the sensor 112 senses the actual air fuel ratio in the combustion chamber. The output of this sensor 112 during a normal control strategy is shown in the upper graph of FIG. 9. It will be seen that the signal fluctuates between a rich and a lean signal. The control strategy is basically such that when the mixture goes rich, the air fuel ratio is lean and then when the mixture shifts to the lean side, the mixture is richened again and hence, the actual sense output varies as generally like a sinusoidal wave.

In order to monitor the condition of the catalyst 83 and determine that it is working in an efficient manner and does not require servicing, there is provided a further combustion condition sensor such as an oxygen ($O_2$) sensor, indicated generally by the reference numeral 132 (FIGS. 3–7) which is disposed in the trap section 86 and downstream of the catalyst bed 83.

By comparing the output signals between the two oxygen sensors 111 and 132, it is possible to determine that the catalyst bed 83 is operating satisfactorily and also so as to ensure that the engine is operated in such a manner so as to achieve good catalytic treatment of the exhaust gases.

The sensor 132 includes a sensor element 133 which can have substantially the same construction as the sensor element 112 of the sensor 111. Because this sensor is disposed so that it will not experience direct combustion products but only products that have already passed through the catalyst bed 83, some of the protective features that are utilized with the previous sensor are not necessary.

Figure 9:
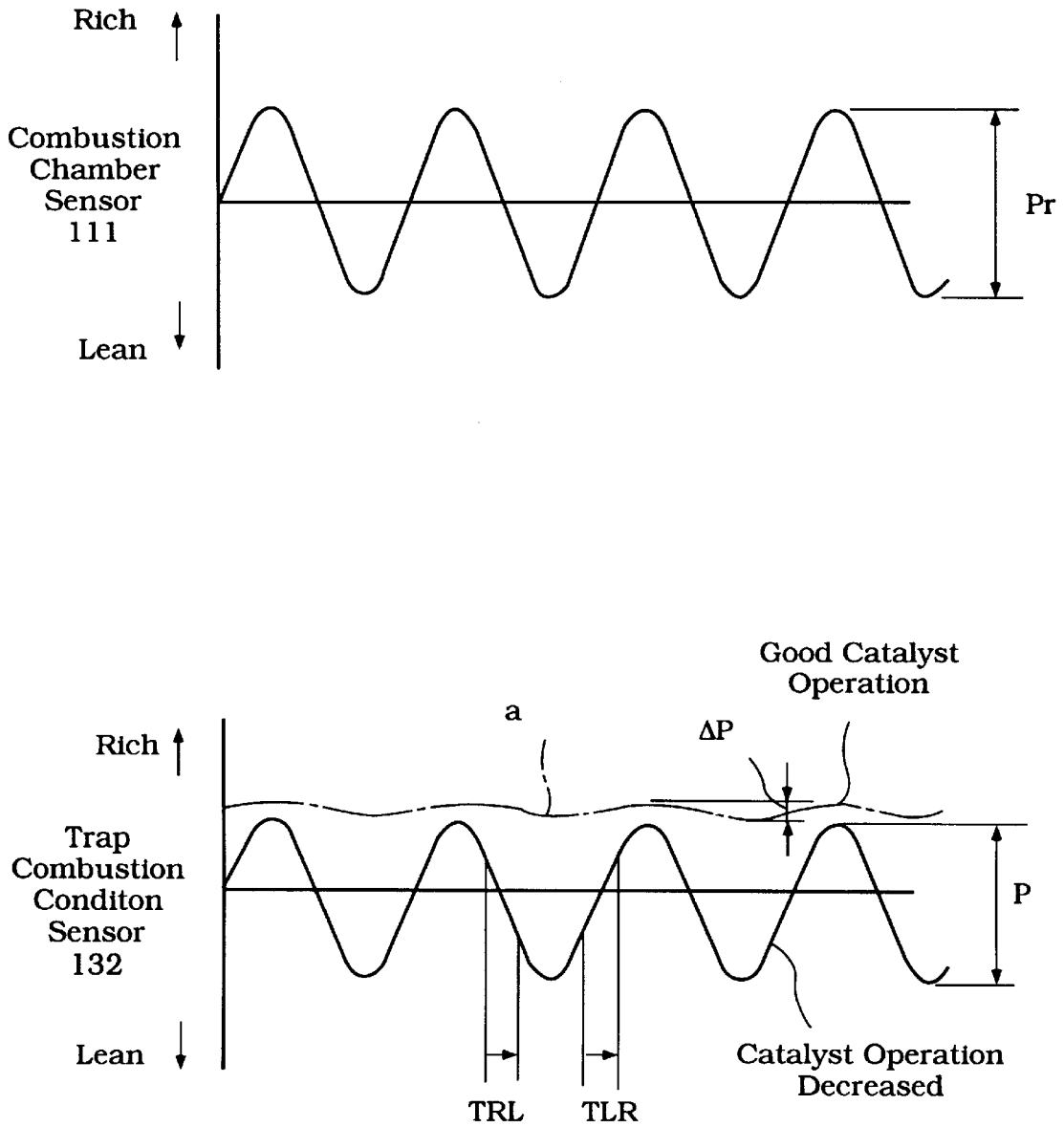
FIG. 9 is a graphical view showing how the condition of the catalyst can be determined to obtain optimum operation with the output of the combustion chamber combustion condition sensor shown in the upper view and the sensor output downstream of the catalyst shown in the lower view.

The output from the sensor 133 is transmitted to the ECU 72 and its output signal is indicated at the lower curve of FIG. 9. As seen in this lower curve, if the oxygen content in the exhaust gases can be maintained low, as is achieved when there is a rich fuel air mixture, the catalyst operation will follow the curve A and have a good cleaning ability. This curve varies at amount indicated by ΔP which is the difference between the maximum cleaning ability and the minimum cleaning ability under this condition.

If, however, the catalyst bed becomes deteriorated then the cleaning ability will be decrease. This decrease in catalyst operation or deterioration of the catalyst can be determined by comparing certain aspects of the upper and lower curves or the output signals. For example, the two curves indicate overall maximum variations between maximum lean and maximum rich of P2 and P1 respectively, comparing the sensor 111 output with the output from the sensor 132. If the difference between these two maximum differences is less than a predetermined value, this is an indication that the converter is deteriorated.

Another way this condition can be sensed is by measuring the time periods TRL when it takes the sensor to switch over from rich to lean and the times TRL when the sensors switches from lean to rich determinations.

If either or both of these values differ from one sensor to the other by more than a predetermined amount, it can be determined that the catalyst requires servicing. Also, the difference curve indicated at A can be compared and if the amount ΔP is more than a predetermined amount, then it can be determined that the catalyst requires replacement.

It should be noted that arrangement is such that the sensor 132 is placed at the highest place in the exhaust system apart from the exhaust manifold and thus, it is well protected from water intrusion. The sensor 111 is placed even higher and thus, is even further protected.

Thus, from the foregoing description it should be readily apparent that the described exhaust system provides good silencing and water flow back control while maintaining a very compact assembly. Also, the arrangement includes a device and system whereby the condition of the catalyst can be determined and monitored so as to provide servicing and/or adjustment where required.

Of course, the foregoing description is that of preferred embodiments of the invention and various changes and modifications can be made without departing from the spirit and scope of the invention, as defined by the appended claims.

We claim:

1. An outboard motor comprised of a power head consisting an internal combustion engine and a surrounding protective cowling, a drive shaft housing and lower unit depending from said power head and containing a propulsion device for an associated watercraft, an exhaust guide plate underlying said engine at the upper end of said drive shaft housing and lower unit, transmission means for driving said propulsion device from said engine including a drive shaft driven from an engine output shaft and journalled for rotation in said drive shaft housing and lower unit on a longitudinal centerline of said outboard motor, said engine having a plurality of vertically spaced cylinders each having at least one exhaust port for discharging combustion products therefrom, and an exhaust system for discharging exhaust gases from said exhaust port to the atmosphere through a body of water which the associated watercraft is operating under at least some running conditions, said exhaust system including an expansion chamber forming member affixed to the underside of said exhaust guide plate and defining therewith an expansion chamber, an exhaust manifold having inlet ends extending from each of said exhaust ports into said expansion chamber through a single outlet located at a point lying substantially on a longitudinal centerline of said outboard motor and at a forward location therein in substantial alignment with said drive shaft, a trap portion formed in substantial part on the upper side of said exhaust guide plate, said trap portion consisting of an inlet section that extends upwardly from an exhaust outlet opening communicating with said expansion chamber immediately to the rear of said exhaust manifold outlet, a horizontally extending section extending generally transversely to said longitudinal centerline and a downwardly extending section lying to one side of said expansion chamber forming member, said exhaust outlet opening being disposed substantially on said longitudinal centerline and at a rearward location from said exhaust manifold.

2. An outboard motor as set forth in claim 1 wherein the exhaust system further includes an exhaust discharge pipe extending from said downwardly extending section to an underwater exhaust gas discharge.

3. An outboard motor as set forth in claim 1 further including a catalyst bed in said exhaust system through which the exhaust gasses pass.

4. An outboard motor as set forth in claim 3 wherein the catalyst bed is positioned upstream of the trap section.

5. An outboard motor as set forth in claim 4 wherein the catalyst bed is positioned in the expansion chamber.

6. An outboard motor as set forth in claim 5 wherein the catalyst bed is mounted on the underside of the exhaust guide plate at the exhaust gas outlet opening.

7. An outboard motor as set forth in claim 3 wherein the engine is provided with a feedback control system including a combustion condition sensor located upstream of the catalyst bed.

8. An outboard motor as set forth in claim 7 further including a second combustion condition sensor for sensing the condition of the exhaust gases at a point contiguous to the downstream end of the catalyst, and means for determining the condition of said catalyst based upon the relative outputs of the combustion condition sensors.

9. An outboard motor as set forth in claim 8 wherein both of the combustion condition sensors are positioned above the normal water level when the outboard motor is mounted on a watercraft.

10. An outboard motor as set forth in claim 8 wherein both of the combustion condition sensors are positioned in the powerhead.

11. An outboard motor as set forth in claim 8 wherein the second combustion condition sensor is positioned in the trap section.

12. An outboard motor as set forth in claim 11 wherein the second combustion condition sensor is positioned at the highest position in the trap section.

13. An outboard motor as set forth in claim 8 wherein the condition of the catalyst is determined by comparing the maximum amplitude of the signals from the two combustion condition sensors.

14. An outboard motor as set forth in claim 8 wherein the sensors are oxygen sensors and the condition of the catalyst is determined by comparing the time the signals from each of the two combustion condition sensors shifts between lean and rich readings.

15. An outboard motor as set forth in claim 8 wherein the condition of the catalyst is determined by comparing the difference between the average value of the signals from the two combustion condition sensors.

16. An outboard motor as set forth in claim 2 wherein the trap section is disposed at one end of the engine.

17. An outboard motor comprised of a power head consisting an internal combustion engine and a surrounding protective cowling, a drive shaft housing and lower unit depending from said power head and containing a propulsion device for an associated watercraft, an exhaust guide plate underlying said engine at the upper end of said drive shaft housing and lower unit, transmission means for driving said propulsion device from said engine, said engine having at least one exhaust port for discharging combustion products therefrom, and an exhaust system for discharging exhaust gases from said exhaust port to the atmosphere through a body of water which the associated watercraft is operating under at least some running conditions, said exhaust system including an expansion chamber forming member affixed to the underside of said exhaust guide plate and defining therewith an expansion chamber, an exhaust manifold extending from said exhaust port into said expansion chamber at a point lying substantially on a longitudinal centerline of said outboard motor and at a forward location therein, a trap portion formed in substantial part on the upper side of said exhaust guide plate, said trap portion consisting of an inlet section that extends upwardly from an exhaust outlet opening communicating with said expansion chamber, a horizontally extending section extending generally transversely to said longitudinal centerline and a downwardly extending section lying to one side of said expansion chamber forming member, said exhaust outlet opening being disposed substantially on said longitudinal centerline and at a rearward location from said exhaust manifold, an exhaust discharge pipe extending from said downwardly extending section to an underwater exhaust gas discharge, said engine having a fuel supply system including a vapor separator on one side of said engine, and an electric starter motor on the other side of said engine.

* * * * *